United States Patent [19]

Ahmed

[11] 4,160,201

[45] Jul. 3, 1979

[54] VOLTAGE REGULATORS

[75] Inventor: Adel A. A. Ahmed, Clinton Township, Hunterdon County, N.J.

[73] Assignee: RCA Corporation, New York, N.Y.

[21] Appl. No.: 914,236

[22] Filed: Jun. 8, 1978

[51] Int. Cl.[2] ..... G05F 1/56; G05F 1/60

[52] U.S. Cl. ..... 323/8; 323/22 T; 330/297

[58] Field of Search ..... 323/1, 4, 8, 19, 22 T; 330/297

[56] References Cited

U.S. PATENT DOCUMENTS

| | | | |
|---|---|---|---|
| 3,555,309 | 1/1971 | Limberg | 307/297 |
| 4,061,959 | 12/1977 | Ahmed | 323/22 T |
| 4,088,941 | 5/1978 | Wheatley | 323/19 X |

*Primary Examiner*—A. D. Pellinen

*Attorney, Agent, or Firm*—H. Christoffersen; A. L. Limberg

[57] ABSTRACT

Improved voltage regulators of a type wherein a feedback network is used for developing an error signal having a magnitude dependent upon the degree to which a portion of the voltage being regulated departs from a voltage proportional to the extrapolated band-gap potential of the material from which first and second semiconductor junctions in the network are formed. More particularly, this error signal is generated at the output of a differential-input amplifier which differentially compares (a) a relatively large reference potential (m+n) times the offset potential across the first semiconductor junction, and (b) a relatively small reference potential m times the offset potential across the second semiconductor junction, augmented by a portion of the voltage being regulated. The factor m is a positive number at least unity; and the factor n, a positive number less than unity. The first and second semiconductor junctions are operated with relatively high and relatively low respective densities of current flow through them. The error signal is applied as a control signal to apparatus for controlling the flow of current between the regulator output terminals, thereby regulating the voltage appearing between them.

11 Claims, 9 Drawing Figures

VOLTAGE REGULATORS

The present invention relates to improved voltage regulators which are of a type including a feedback network for developing an error signal having a magnitude dependent upon the amount by which the sum of a predetermined portion of the voltage being regulated and a relatively small reference potential differs from a relatively large reference potential, which error signal is then used for correcting the value of the voltage being regulated. The relatively small and relatively large reference potentials are proportional to the offset potentials across respective semiconductor junctions respectively operated at relatively low and relatively high current densities.

Monolithic integrated circuits commonly regulate voltages to the extrapolated bandgap potential of the semiconductor material in which they are formed. Early in this art a potential n times as large as the extrapolated bandgap potential was developed as the difference between (a) the offset potential across a first string of forward biased semiconductor junctions, (m+n) in number, operated at relatively high current density level and (b) the offset potential across a second string of forward-biased semiconductor junctions, m in number, operated at relatively low current density level, m and n being integers. Techniques of this nature are described by D. F. Hilbiber in U.S. Pat. No. 3,271,660 issued Sept. 6, 1966, and entitled "Reference Voltage Source" and by S. A. Graf in U.S. Pat. No. 3,648,153 issued Mar. 7, 1972, and entitled "Reference Voltage Source." The type of voltage feedback network described by Hilbiber and Graf has become less popular to use because the semiconductor junctions and/or the current scaling networks used to create different current density levels in the semiconductor junctions in each string tend to take up too much area on an integrated circuit die.

A feeling for why this is so can be obtained by viewing these circuits as adding m times the incremental difference potential $\Delta V_{OFF}$ between a pair of semiconductor junctions to n of the forward-biased semiconductor junctions in the first string to simulate the operation of the n forward-biased semiconductor junctions at a higher level of current density, so much higher that their offset voltages are constant with temperature. That is, the operation simulates the tendency, for a forward-biased semiconductor junction to exhibit decreased negative temperature coefficient with increased current density level, being exploited to so high a degree that the negative temperature coefficient is reduced to zero. The positive temperature coefficient potential m $\Delta V_{OFF}$ must be of a magnitude equal to n times the following: the extrapolated bandgap potential, which is about 1.2 volts for silicon junctions, minus the forward offset potential $V_{OFF}$ of each of the semiconductor junctions in the first string, which forward offset potential will be somewhere around 0.7 volts. So, the $m\Delta V_{OFF}$ potential must have a value of about 0.5 n volts.

The $\Delta V_{OFF}$ expected between a pair of semiconductor junctions is $(kT/q)\ln(J_1/J_2)$ where k is Boltzmann's constant, T is the absolute temperature at which the junctions are operated, q is the charge of an electron, and $J_1$ and $J_2$ are the respective densities of current flow through the junctions. At 300K, (kT/q) has a value of 26 millivolts, so $\ln(J_1/J_2)$ must have a value around 20(n/m). That is, $(J_1/J_2)$ must have a value of about exp(20n/m). For the case where n equals unity, $(J_1/J_2)$ must have a value of about exp(20/m).

Large values of $J_1/J_2$ require that the respective areas of the junctions in each pair differ in large amount, that the respective levels of forward-bias currents through the junctions in each pair differ in large amount, or that both of the foregoing types of differences exist in sufficient amount. The first approach takes up large amounts of monolithic die area for each junction pair since there is a minimum area that the smaller of the junctions needs to take up and the larger of the junctions takes up a correspondingly larger area. The second approach takes up large amounts of die area for the current scaling network. So in a practical design one attempts to reduce the required value of $J_1/J_2$ by increasing m.

Increasing m increases the length of the first and second strings of semiconductor junctions, which tends to take up increased area on the monolithic die and limits the degree to which this technique is useful. Also the maximum value of m is constrained by the supply voltage available to forward-bias the (m+n) junctions in the first string.

In the attempt to reduce the area taken up by voltage supplies regulating their output voltages so as to be proportional to extrapolated bandgap voltage, workers in the art have turned to scaling up the difference $\Delta V_{OFF}$ between the respective offset potentials of a single pair of forward-biased semiconductor junctions operated respectively with relatively low and relatively high densities of current flow through them. This is done to obtain a positive-temperature-coefficient potential which, when added to the $V_{OFF}$ offset potential appearing across one of the junctions, simulates the high-current-density operation of a single semiconductor junction that theoretically results in a zero-temperature-coefficient offset potential across the single semiconductor junction. This zero-temperature-coefficient potential is equal to the extrapolated bandgap potential (e.g., 1.205 volts for silicon junctions).

This approach underlies the voltage regulators described by R. C. Dobkin in U.S. Pat. No. 3,617,859 issued Nov. 2, 1971, and entitled "Electrical Regulator Apparatus Including a Zero Temperature Coefficient Voltage Reference Circuit"; by A. P. Brokaw in U.S. Pat. No. 3,887,863 issued June 3, 1957, and entitled "Solid State Regulated Voltage Supply"; by K. Toyoda in U.S. Pat. No. 4,007,415 issued Feb. 8, 1977, and entitled "Constant Voltage Generating Circuit," and by others. As pointed out by K. E. Kuijk in the article "A Precision Reference Voltage Source" appearing on pp. 222–226 of *IEEE Journal of Solid State Circuits*, Vol. SC-8, No. 3, June 1973, inaccuracies in the $\Delta V_{OFF}$ scaling are a practical problem which makes it difficult to achieve reference voltages with sufficiently low temperature coefficients over most of the production run of integrated circuits.

Inaccuracies creep in owing to differential input offset error and to drift therein if an operational amplifier configuration is used for scaling up $\Delta V_{OFF}$ — e.g., as in the Brokaw and Toyoda regulators. Inaccuracies creep in owing to transistor base currents flowing in only some of the scaling resistors where one avoids the use of operational amplifiers for scaling up $\Delta V_{OFF}$ — e.g., as in the Dobkin regulator. Another problem with regulators of the type described by Dobkin and by Brokaw is that their circuits do not readily permit adjustment of the forward-bias current levels through the semiconductor junction. This adjustment is a practical necessity, however, since one cannot precisely predict the value of the negative temperature-coefficient $V_{OFF}$ component of the regulated voltage, which depends upon doping profiles. These shortcomings led the present inventor to re-examine regulators of the type described by Hilbiber and Graf.

It is known — e.g., from U.S. Pat. No. 3,555,309 issued to A. L. R. Limberg on Jan. 12, 1971, and entitled "Electrical Circuits" — that a potential similar to that across a string of diodes can be developed across the input circuit of a resistive potential divider included in a direct-coupled collector-to-base degenerative feedback connection of a transistor, the output circuit of the potential divider being connected across the emitter-base junction of the transistor. This reference-potential-generating configuration can provide voltages which are m or (m+n) times the offset potential across the emitter-base junction of a transistor, where m and (m+n) are any positive number greater than unity, without the restriction that m or (m+n) need be integral.

The present invention is embodied in regulators of the general type described by Hilbiber and Graf wherein at least one, if not both of, the strings of diodes is replaced by a respective reference-potential-generating configuration generating a respective reference potential in non-integral proportion to the offset voltage across a forward-biased semiconductor junction, this being done to obtain greater flexibility in choice of n/m ratio. Of particular interest is the specific case wherein n is chosen to be only a fraction of unity, so that $(J_1/J_2)$ may have a value of about exp (20 n/m), where m does not have to be as large. This leads to regulator circuits more economical of integrated circuit die area.

Figure 1:
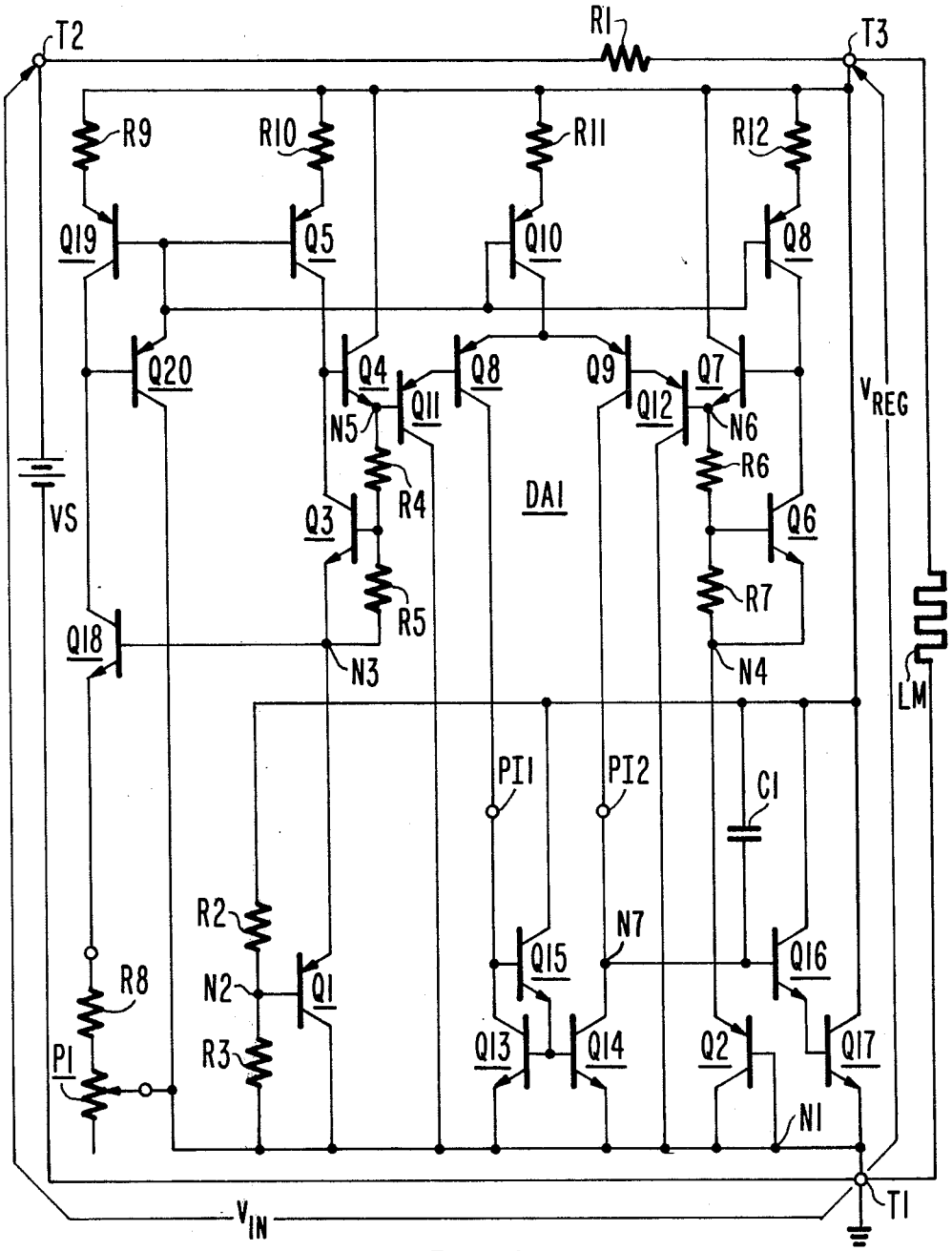
FIGS. 1 and 2 are schematic diagrams of shunt voltage regulators having respective feedback networks embodying the present invention.

In the FIG. 1 regulator circuitry, voltage source VS applies an unregulated direct potential between terminals T1 and T2. Voltages will be referred to the potential at a first node N1 shown connected via terminal T1 to a ground reference point. Load means LM is connected between terminals T1 and T3, and the voltage $V_{REG}$ between these terminals is regulated by a shunt voltage regulator comprising the remaining elements shown in FIG. 1. These remaining elements will for the most part generally be constructed in monolithic integrated circuit form.

Resistors R2 and R3 having respective resistances $R_2$ and $R_3$ are in potential divider connection to apply a predetermined portion of $V_{REG}$ to a second node N2 at the base of a PNP emitter-follower transistor Q1. The base potential $V_{BQ1}$ of Q1 will have a value $R_3V_{REG}/(R_2+R_3)$, and the emitter potential $V_{EQ1}$ of Q1, applied to a third node N3, will be the emitter-to-base offset potential $V_{BEQ1}$ of Q1 more positive than $V_{BQ1}$. The potential at node N1 is applied as base potential to another PNP emitter-follower transistor Q2. The emitter-follower action of Q2 maintains a fourth node N2, to which the emitter of Q2 connects, at an emitter potential $V_{EQ2}$ which is equal to the emitter-to-base offset potential $V_{BEQ2}$ of Q2.

NPN transistors Q3 and Q4, the constant current generator collector load provided Q3 by the collector circuit of a PNP transistor Q5, and the resistors R4 and R5 form a first reference-potential-generating configuration of the sort described in the Limberg patent. Q3 is provided with a direct-coupled collector-to-base feedback connection via the emitter-follower action of Q4 and the potential divider action of R4 and R5. This feedback connection adjusts $V_{BEQ3}$ to condition Q3 to conduct, as collector current, all of the constant current supplied from the collector electrode of Q5 except for the relatively negligible base current of Q4. To apply this value of $V_{BEQ3}$, the potential divider formed by resistors R4 and R5 must be supplied an input potential between node N3 and a fifth node N5 which is $(R_4+R_5)/R_5$ times the emitter-to-base offset potential $V_{BEQ3}$ of Q3, where $R_4$ and $R_5$ are the respective resistances of R4 and R5. Node N5 is thus at a potential essentially equal to $[R_3V_{REG}/(R_2+R_3)]+V_{BEQ1}+[(R_4+R_5)V_{BEQ3}/R_5]$.

NPN transistors Q6 and Q7, the constant current generator collector load provided by the collector circuit of a PNP transistor Q8, and resistors R6 and R7 with respective resistances $R_6$ and $R_7$ form a second reference-potential-generating configuration of the sort described by Limberg. This second reference-potential-generating configuration regulates the potential between the fourth node N4 and a sixth node N6 to a value essentially $(R_6+R_7)/R_7$ times the emitter-to-base offset potential $V_{BEQ6}$ of Q6. This is done in a manner analogous to that in which the first reference-potential-generating configuration regulates the potential between nodes N3 and N5 to a value essentially $(R_4+R_5)/R_5$ times $V_{BEQ3}$. Node N6 is thus at a potential equal to $V_{BEQ2}+[(R_6+R_7)V_{BEQ6}/R_7]$.

$V_{BEQ6}$ is made to be smaller than $V_{BEQ3}$. This is most conveniently done by (a) appropriately scaling the collector currents of Q5 and Q8, which the collector-to-base feedback connections of Q3 and Q6 cause their respective collector currents substantially to equal, (b) making the effective area of the emitter-base junctions of Q3 and Q6 respectively small and large, or (c) employing both of the foregoing procedures.

Nodes N5 and N6 are at the non-inverting and inverting input connections respectively of a differential-input amplifier DA1 having an output connection at a seventh node N7. DA1 comprises: PNP transistors Q8 and Q9 in long-tailed pair connection, receiving tail current at the interconnection of their emitters from the collector of a PNP transistor Q10; PNP emitter-follower transistors Q11 and Q12 applying the signals received at the non-inverting and inverting input signal connections, respectively, to the bases of PNP transistors Q8 and Q9, respectively; and a current mirror amplifier including NPN transistors Q13, Q14 and Q15 connected as master, slave, and emitter-follower transistors, respectively, for converting the balanced collector current variations of Q8 and Q9, received at points of interconnection PI1 and PI2, respectively, to single-ended form to appear at node N7.

An error signal which is a current proportional to the difference between the voltages applied at nodes N5 and N6 appears at node N7 to be applied to means for shunt regulating the potential appearing between terminals T1 and T3. This means comprises NPN transistors Q16 and Q17 in Darlington connection, the base of Q16 receiving the error signal, the emitters of Q16 and Q17 being respectively connected to the base of Q17 and to terminal T1, and the collectors of Q16 and Q17 being connected to terminal T3. capacitor C1 provides a Miller feedback connection for the Darlington configuration that determines the primary roll-off in frequency response of the overall feedback loop which controls the shunt regulation of $V_{REG}$.

To evaluate the operation of the overall feedback loop which controls the shunt regulation of $V_{REG}$, consider a tendency for $V_{REG}$ to increase beyond its design value. This might occur because of increase in the unregulated direct potential $V_{IN}$ applied between terminals T1 and T3 by voltage source VS or because of decrease in the load applied between terminals T1 and T3. A portion of any such increase in $V_{REG}$ would be applied by the resistive divider action of R2, R3 to the base of emitter-follower transistor Q1 to make its emitter potential applied to node N3 more positive. This would make the potential at node N5, regulated with respect to the potential at node N3, more positive. Node N5 is located at the non-inverting input connection of DA1.

At the same time the potential at node N6 and the inverting input connection of DA1, as determined by the emitter-follower action of Q2 regulating the potential at node N4 and the regulator action exhibited by the elements linking nodes N4 and N6, would remain substantially unchanged. The output connection of differential-input amplifier DA1, at node N7, would respond with a more positive-going error signal that tends to increase the conduction of Q16 and consequently of Q17. Increased conduction of Q16 and particularly of Q17 increases the flow of current from the source VS of unregulated direct potential through dropping resistor R1. The greater current flow through R1 increases the voltage drop thereacross and maintains $V_{REG}$ at its prescribed value.

Conversely, a tendency towards reduction of $V_{REG}$, owing to reduction of $V_{IN}$ applied between terminals T1 and T2 or to increase in the load applied between terminals T1 and T3, tends to make the potentials at nodes N2, N3 and N5 less positive. Amplifier DA1 responds to reduction of the potential applied to its non-inverting input connection at node N5 to decrease the forward bias applied to the base-emitter circuits of Q16 and Q17. The resulting reduction in the conduction of Q16 and Q17 decreases the current flow through dropping resistor R1, decreasing the voltage drop thereacross and compensating for the decrease in the unregulated voltage from source VS.

More particularly, the error signal at node N7 is proportional to $[R_3V_{REG}/(R_2+R_3)]+V_{BEQ1}+[(R_4+R_5)V_{BEQ3}/R_5]-\{V_{BEQ2}+[R_6+R_7)V_{BEQ6}/R_7]\}$. By scaling the effective areas of the emitter-base junctions of Q1 and Q2 to be in the same ratio as their emitter currents, $V_{BEQ1}$ and $V_{BEQ2}$ are caused to be equal. Then, the error signal is proportional to $R_3V_{REG}/(R_2+R_3)+[(R_4+R_5)V_{BEQ3}/R_5]-[(R_6+R_7)V_{BEQ6}/R_7]$. Assuming the error signal to be reduced to very low value, essentially zero, the resulting equation can be solved to determine the value of $V_{REG}$ necessary to achieve this equilibrium condition, viz:

$$V_{REG}=[1+(R_2/R_3)]\{[1+(R_6/R_7)]\ V_{BEQ6}-[1+(R_4/R_5)]V_{BEQ2}\}.$$

In the foregoing equation $[1+(R_6/R_7)]$ corresponds to $(m+n)$ and $[1+(R_4/R_5)]$ corresponds to m of the earlier portion of the specification. The factor $[1+(R_6/R_7)]$ is chosen such that the potential $[1+(R_6/R_7)]V_{BEQ6}$ is sufficiently smaller than the regulated potential appearing between terminals T1 and T3 that all portions of the circuit have sufficient operating voltage available to them. The factor $[1+(R_4/R_5)]$ is chosen smaller than the factor $[1+(R_6/R_7)]$, preferably by a proper fraction of unity, usually ranging from 1/6 or 1/5 up to ½, thereby to achieve practical reductions of m by a factor from 2 to 5 or 6.

$R_5$ and $R_7$ preferably are chosen such that the ratio of $R_5$ to $R_7$ is nearly the inverse of the ratio of the collector current of Q5 to that of Q8 and of the ratio of the effective area of the emitter-base junction of Q1 to that of Q2; this results in the emitter currents $I_{EQ1}$ and $I_{EQ2}$ being in substantially the same ratio as the effective areas of their respective emitter-base junctions, keeping their respective emitter-to-base offset-potentials $V_{BEQ1}$ and $V_{BEQ2}$ substantially equal. In this preferred structure the currents flowing through the collector-to-emitter path of Q3 and through resistors R4 and R5 ideally are in a ratio with each other equal to the ratio of the currents flowing through the collector-to-emitter path of Q6 and through resistors R6 and R7. One may thus employ, without substantial adverse effect, an alternate structure, dispensing with emitter-follower transistors Q4 and Q7, connecting node N5 directly to the interconnection between the collectors of Q3 and Q5, and connecting node N6 directly to the interconnection between the collectors of Q6 and Q8. The arrangement shown in FIG. 1 is preferable in that the base currents of Q11 and Q12 are buffered by Q4 and Q7, to reduce their effects upon the portions of the collector currents of Q5 and Q8 flowing as collector currents in Q3 and Q6, respectively.

The factors $[1+(R_4/R_5)]$ and $[1+(R_6/R_7)]$ preferably being a few times unity, while their difference is only a fraction of unity, results in the resistors R4 and R6 being scaled in nearly the same proportions to resistors R5 and R7 respectively. As noted before, the ratio of $R_5$ and $R_7$ is preferably nearly the inverse of the ratio of the collector current of Q5 to that of Q8. Assuming Q3 and Q6 to have similar common-emitter forward current gains ($h_{fe's}$), their respective base currents will be in similar ratio as their respective collector currents. These relationships result in the base currents of Q3 and Q6, flowing as components respectively of the currents flowing through resistors R4 and R6, being in substantially inverse proportion to the resistances of R4 and R6. The IR drops in resistors R4 and R6 attributable to the base currents of Q3 and Q6, respectively, thus tend to be similar. These IR drops are therefore for the most part common-mode components of the potentials applied to the input terminals of differential input amplifier DA1, and DA1 suppresses response to them at node N7 owing to its common-mode rejection. Thus the base current error problems of earlier regulator feedback network designs are for the most part overcome.

In FIG. 1 the collector currents of Q5, Q8 and Q10 are determined as follows, so that they exhibit substantially no temperature dependency, assuming $V_{REG}$ to exhibit substantially no temperature dependency. The fraction of $R_{REG}$ at node N2 exhibits no temperature dependency so long as the resistances $R_2$ and $R_3$ of potential divider resistors R2 and R3 are in temperature-independent ratio, easily achieved in monolithic structures where the resistors are diffused resistors having similar doping profiles, for example. Node N3 is at a potential equal to this temperature-independent fraction of $V_{REG}$, plus $V_{BEQ1}$, and is connected to the base of a NPN transistor Q18. The emitter-to-base offset potential $V_{BEQ18}$ of Q18 compensates for the $V_{BEQ1}$ component of the base potential $V_{BQ18}$ of Q18 so the emitter potential $V_{EQ18}$ of Q18 is essentially equal to the temperature-independent fraction of $V_{REG}$ at node N2. A zero-temperature-coefficient resistance between the emitter of Q18 and ground potential, as provided by the series resistance of resistor R8 and potentiometer P1 in rheostat connection, will cause temperature-independent emitter current $I_{EQ18}$ flow from Q18. The collector current $I_{CQ18}$ of Q18, being equal to $I_{EQ18}$ except for the negligibly small base current $I_{BQ18}$ of Q18, will be essentially temperature-independent.

$I_{CQ18}$ is then the input current for a plural-output current mirror amplifier comprising, in addition to PNP slave transistors, Q5, Q8 and Q10, a PNP master transistor Q19 and a PNP emitter-follower transistor Q20 providing a direct-coupled collector-to-base feedback connection for Q19. The conductances of emitter resistors R9, R10, R11 and R12 of transistors Q19, Q5, Q10 and Q8, respectively, are chosen in the same ratio as desired for their respective collector currents. The respective collector currents of Q19, Q5, Q10 and Q8 are determined by the effective areas of their respective emitter-base junctions where they are separate lateral structure transistors. Alternatively, the transistors may be replaced by a single multiple-collector transistor with the ratio of the collector currents being determined by the relative efficiency of each collector as determined by the relative area of its respective collector-base junction.

Adjusting P1 to change the emitter resistance of Q18 adjusts its collector current and, by virtue of the current mirror amplifier action alluded to in the previous paragraph, the collector currents of master transistor Q19 and slave transistors Q5, Q10 and Q8. The direct-coupled collector-to-base feedback connections of Q3 and Q6 adjust their collector currents substantially to equal the changed collector currents of Q5 and Q8, respectively. The changes in the collector currents of Q3 and Q6 are in like ratio, changing both $V_{BEQ3}$ and $V_{BEQ6}$, but leaving the difference between them unchanged. That is, the predictable postive-temperature-coefficient component of $V_{REG}$, $[1+(R_2/R_3)][1+(R_4/R_5)](V_{BEQ6}-V_{BEQ2})$, remains unchanged. The negative-temperature-coefficient component of $V_{REG}$, $[(R_6/R_7)-(R_4/R_5)]V_{BEQ6}$, is adjustable responsive to adjustment of P1, within limits, to adjust $V_{REG}$ to its zero-temperature-coefficient design-center value.

In less critical applications where adjustment of $I_{CQ18}$ is not necessary, Q18 may be provided with an integrated positive-temperature-coefficient emitter resistance to node N1 and may be biased at its base electrode with an appropriate fraction of $V_{REG}$ to cause $I_{CQ18}$ to be substantially temperature-independent.

Figure 2:
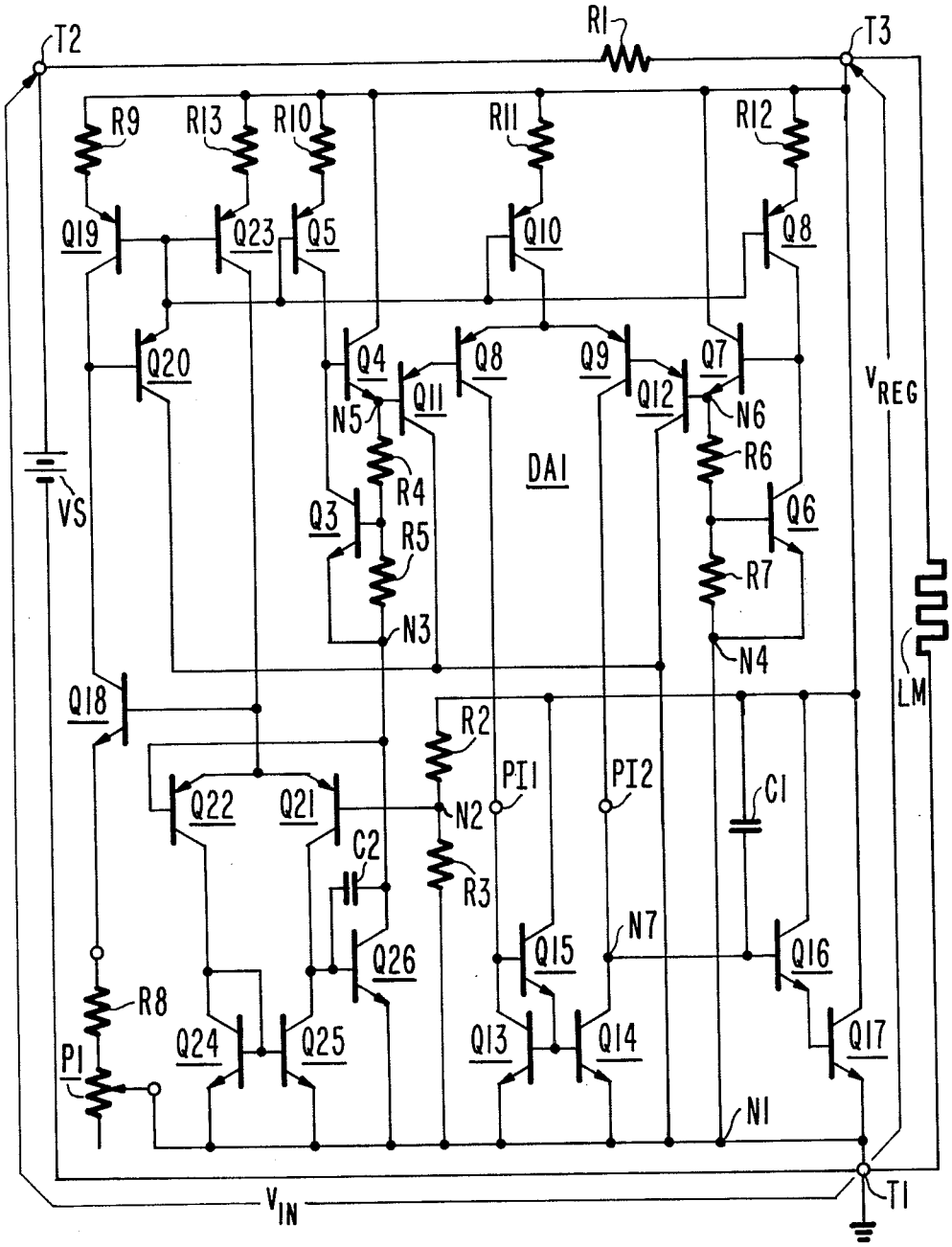

FIG. 2 shows a modification of the FIG. 1 shunt voltage regulator circuit, wherein emitter-follower transistor Q1 is replaced by means for maintaining a zero potential offset between nodes N2 and N3, and wherein emitter-follower transistor Q2 is replaced by a direct connection without substantial intervening impedance between nodes N1 and N4. The means for maintaining a zero potential offset between nodes N2 and N3 includes: PNP transistors Q21 and Q22 connecting in long-tailed pair configuration receiving tail current at their interconnected emitters from the collector of a PNP transistor Q23, the potential at node N2 being applied to the base of Q21; NPN transistors Q24 and Q25 serving as the master and slave transistors, respectively, of a current mirror amplifier for converting the balanced collector current variations of Q21 and Q22 to a single-ended signal; an NPN grounded-emitter amplifier transistor Q26 having that single-ended signal applied to its base and having its collector connected to node N3; and means for applying the potential at node N3 essentially without offset to the base of Q22 for completing a direct-coupled feedback loop which degenerates the difference in potential between nodes N2 and N3 substantially to zero. A capacitor C2 is included for protecting the feedback loop against self-oscillation, being connected across the collector-base junction of Q26 to take advantage of Miller multiplication, as shown, or across its emitter-base junction.

Q23 is connected as a further slave transistor in the plural-output current mirror amplifier comprising Q19, Q5, Q10 and Q8. Q23 is provided an emitter degeneration resistor R13 scaled in conductance with R9, R10, R11 and R12 as the collector current of Q23 is with the collector currents of Q19, Q5, Q10, and Q8, respectively. Q21 performs the same function insofar as offsetting the base electrode of Q18 from node N2 that Q1 does in the FIG. 1 regulator.

The FIG. 2 regulator does not require that the currents flowing through nodes N3 and N4 be kept in strict ratio so that the offset potentials across potential followers may be kept equal. This leaves one the freedom to adjust the respective resistances of R4 and R6 so the IR drops across them due to the base currents of Q3 and Q6 can be made still more equal, so the common-mode rejection of differential input amplifier DA1 can even more completely suppress response to them at node N7.

Figure 3:
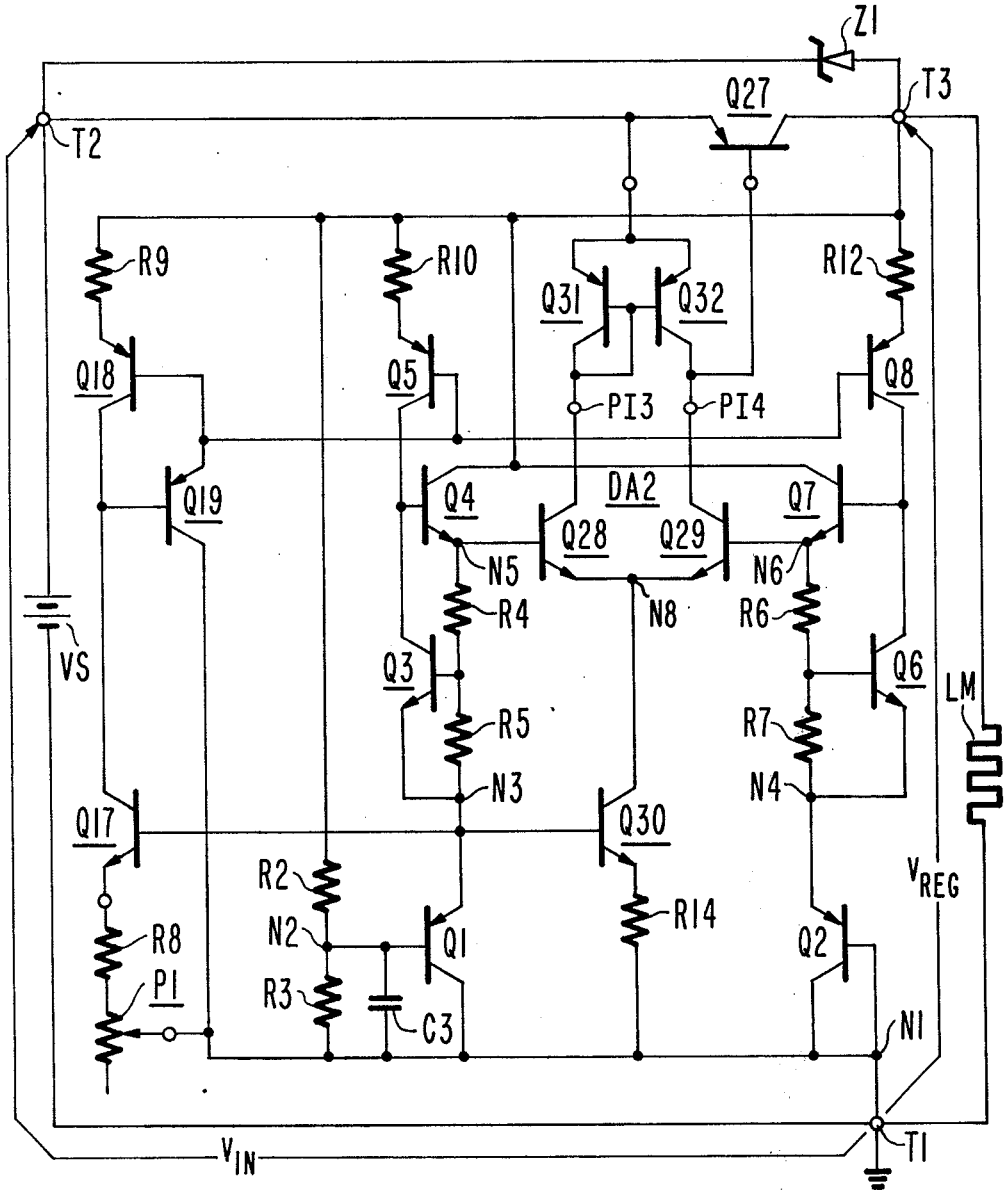
FIGS. 3 and 4 are schematic diagrams of series voltage regulators having feedback networks embodying the present invention.

FIG. 3 shows series regulator circuitry wherein voltage source VS applies an unregulated direct potential between terminal T2 and terminal T2 at the emitter of a PNP series regulator transistor Q27. Q27 has its collector connected to terminal T3. The conduction of Q27 is adjusted by an error signal applied to its base to provide a voltage drop across the collector-to-emitter path of Q27 which exhibits variations that compensate for any variations exhibited by $V_{IN}$ and any variations in the conductivity of the load means LM, so that the potential $V_{REG}$ remains substantially constant. Differential-input amplifier DA2 replaced differential-input amplifier DA1 for developing the error signal in response to the difference between potentials at nodes N5 and N6, the replacement being made to accommodate the changed requirements with regard to correct biasing of the PNP series regulator transistor Q27 as compared to that of the NPN shunt regulator transistor Q17. DA2 includes NPN transistors Q28 and Q29 in long-tailed-pair connection, having their respective bases connected to nodes N5 and N6, respectively; having their respective collectors connected to points of interconnection PI3 and PI4, respectively; and having their emitters connected together at a node N8. A transistor Q30 has its emitter connected to node N1 via a resistor R14, has its base biased from node N3, and has its collector connected to node N8 to withdraw tail current from the long-tailed-pair connection of Q28 and Q29. DA2 further includes PNP transistors Q31 and Q32 for converting the balanced collector current variations of Q28 and Q29 appearing at points of interconnection PI3 and PI4 to single-ended form for application as error signal to the base electrode of Q27. Avalanche diode Z1 connects terminals T2 and T3 to apply an initial energizing potential smaller than $V_{REG}$ to the feedback network elements when source VS first applies $V_{IN}$ between terminals T1 and T2. Capacitor C3 paralleling $R_3$ defines the dominant time constant in the feedback network to stabilize it against self-oscillatory tendencies.

Figure 4:
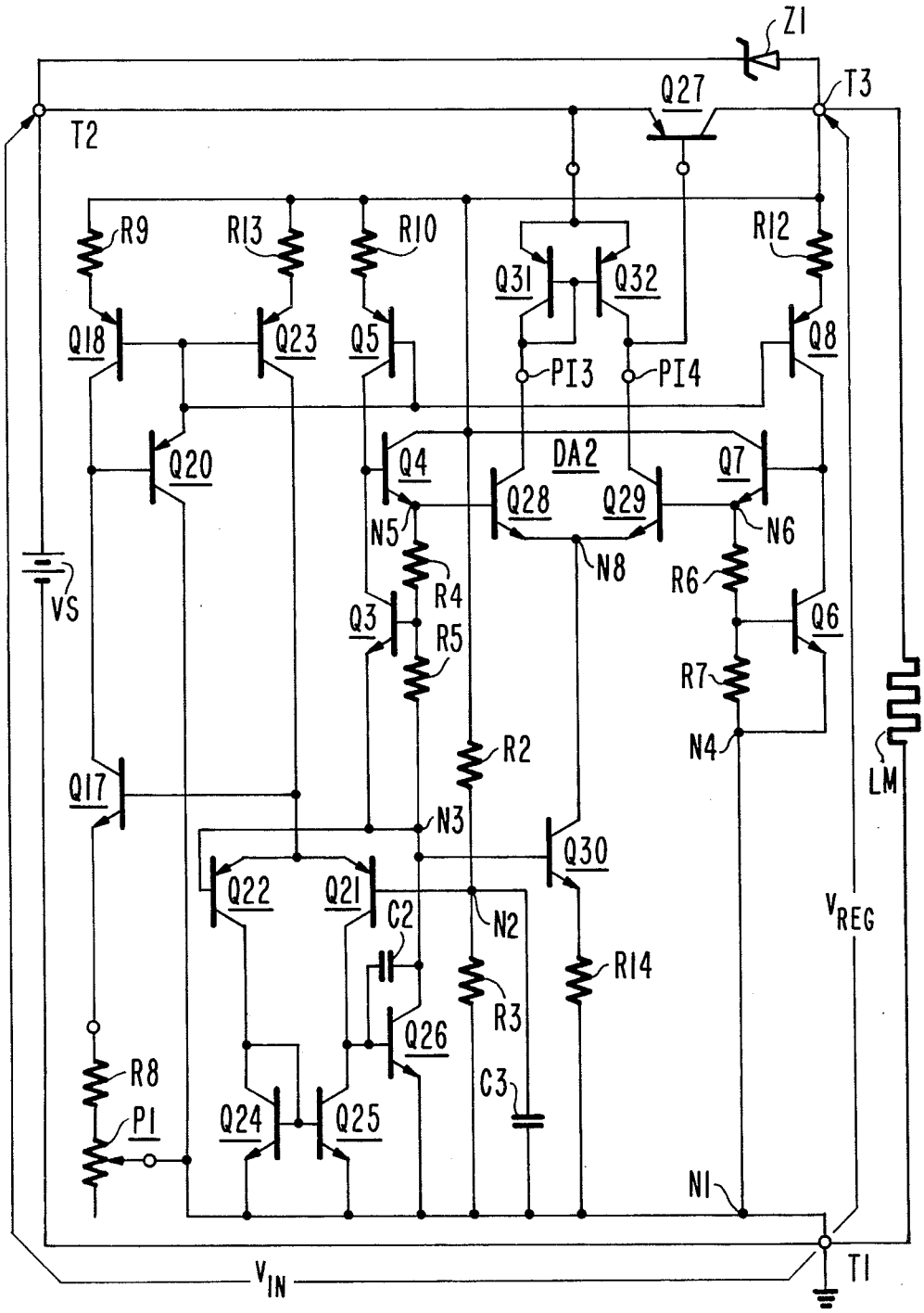

FIG. 4 shows a series voltage regulator similar in most respects to the FIG. 3 series voltage regulator. However, as in the FIG. 2 shunt voltage regulator, node N2 is coupled to node N3 by a zero-offset potential follower circuit, and node N4 is connected directly without substantial intervening impedance to node N1.

Figure 5:
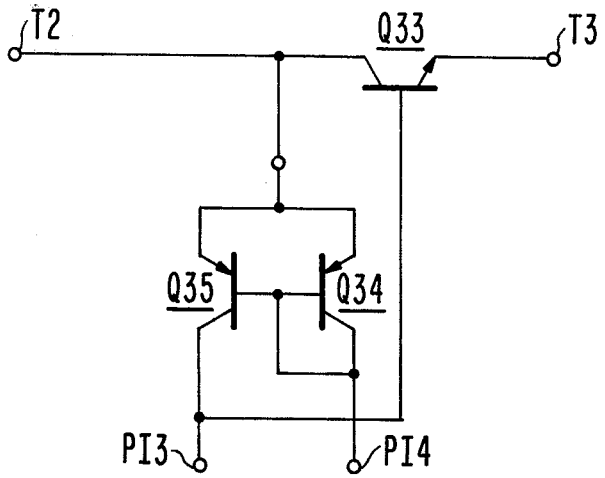
FIG. 5 is a schematic diagram of a portion of an alternative series voltage regulator connection for using a similar feedback network to that of FIG. 3 or 4.

FIG. 5 shows a modification that can be made to the FIG. 3 or FIG. 4 regulator to accommodate an NPN series regulator transistor Q33, with collector and emitter connected to terminals T2 and T3, instead of PNP series regulator transistor Q27. The current mirror amplifier connection of Q31 and Q32 having input and output connections to PI3 and to PI4, respectively, is replaced by a current mirror amplfier connection of PNP transistors Q34 and Q35 having input and output connections to PI4 and to PI3, respectively.

Figure 6:
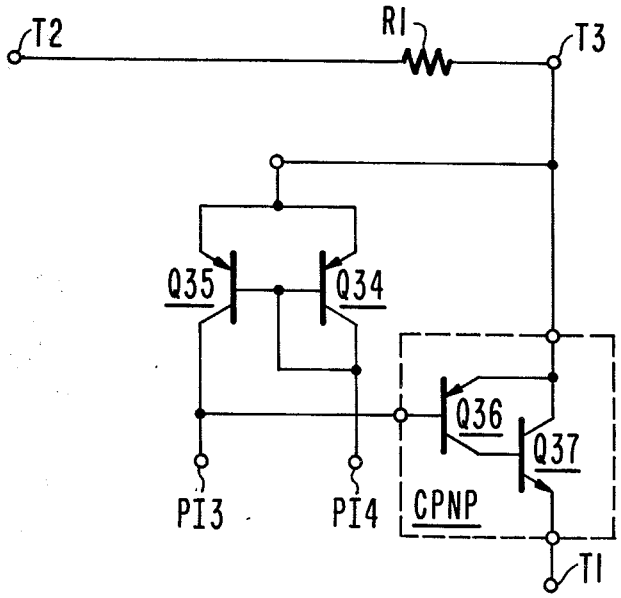
FIG. 6 is a schematic diagram of a portion of an alternative shunt voltage regulator connection for using a similar feedback network to that shown in FIGS. 3 or 4.

FIG. 6 shows a modification that can be made to the FIG. 3 or FIG. 4 series voltage regulator, which results in a shunt voltage regulator. Series regulator transistor Q27 is replaced by dropping resistor R1, connected between terminals T2 and T3, and a composite PNP transistor CPNP is used to shunt regulate the potential appearing between terminals T1 and T3. The composite transistor CPNP includes a PNP transistor Q36 and an NPN transistor Q37, has an equivalent "base" electrode at the base of Q36, has an equivalent "emitter" electrode to which the emitter of Q36 and the collector of Q37 connect, includes a direct coupling of the collector of Q36 to the base of Q37, has an equivalent "collector" electrode at the emitter of Q37, and exhibits a current gain between "base" and "collector" electrodes which is substantially equal to the product of the current gains ($h_{fe's}$) of Q36 and Q37. The equivalent "emitter" and "collector" electrodes of composite PNP transistor CPNP connect to terminals T3 and T1, respectively; and its base electrode is connected to point of interconnection P13. Q34 and Q35 are connected as a current mirror amplifier with input and output connections at PI4 and PI3, respectively, for converting the balanced variations in the collector currents of Q28 and Q29 to single-ended form for application to the "base" electrode of composite PNP transistor CPNP.

Note that the emitters of Q35 and Q34 are preferably connected to terminal T3, rather than to terminal T2 as is shown in FIG. 3, so that the clamping action of the base-emitter junction of Q36 maintains the emitter-to-collector potentials of Q34 and Q35 equal. This improves the constancy of current gain exhibited by the current mirror amplifier Q34 and Q35 form.

Figure 7:
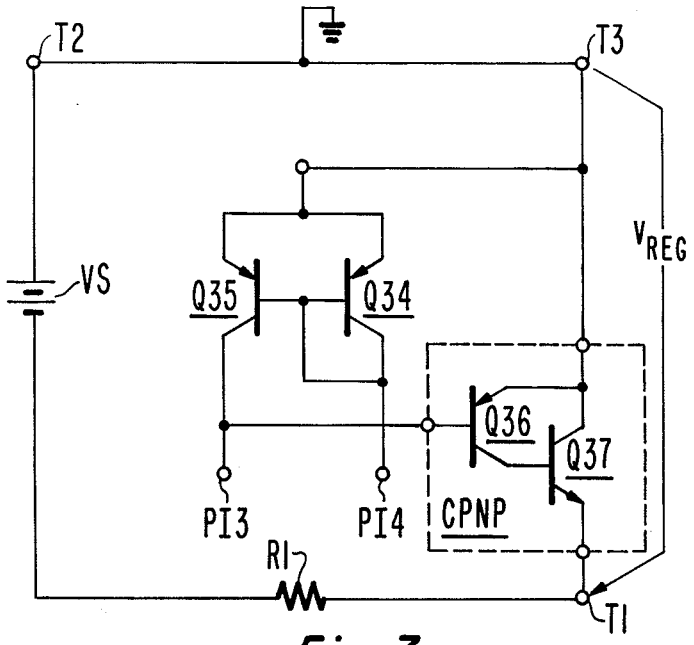
FIG. 7 is a schematic diagram of a portion of an alternative shunt voltage regulator connection for using a similar feedback network to that shown in FIGS. 3 or 4.

FIG. 7 shows a modification that can be made to the FIG. 3 or FIG. 4 regulator which results in a shunt voltage regulator for maintaining a negative voltage between terminals T3 and T1. This modification is similar to the FIG. 6 modification insofar as the connections of Q34, Q35, Q36 and Q37 are concerned. However, the ground connection is relocated from terminal T1 to an interconnection between terminals T2 and T3, and dropping resistor R1 is inserted between the negative pole of voltage source VS and terminal T1.

Figure 8:
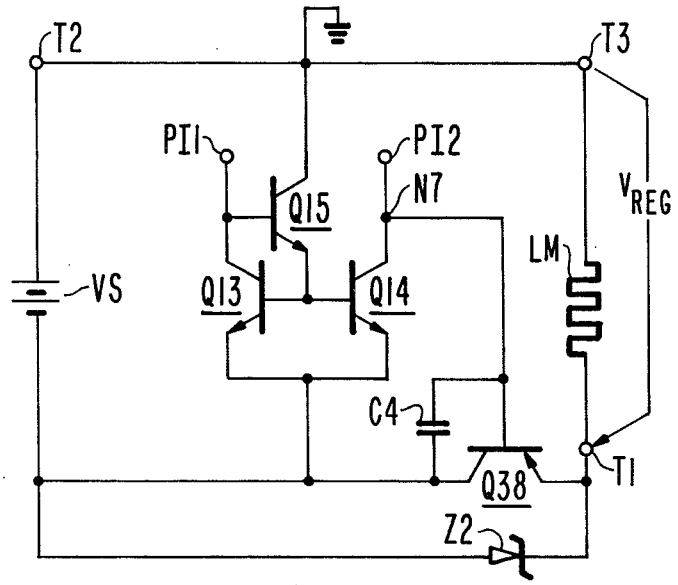
FIG. 8 is a schematic diagram of a portion of an alternative series voltage regulator connection for using a similar feedback network to that shown in FIGS. 1 or 2.

FIG. 8 shows a modification that can be made to the FIG. 1 or FIG. 2 regulator which results in a series voltage regulator for maintaining a negative voltage between terminals T1 and T3. The ground connection is relocated from terminal T1 to an interconnection between terminals T2 and T3. T1 is connected to the negative pole of voltage source VS, not directly without intervening impedance, but rather by a PNP series regulator transistor Q38 having its emitter connected to T1 and its collector connected to the negative pole of VS. The emitters of Q13 and Q14 are connected to the negative pole of voltage source VS rather than to terminal T1. Node N7 is connected to the base of Q38, and transistors Q16 and Q17 are dispensed with. C1 is dispensed with, C4 providing the dominant time constant in the regulator feedback loop. Avalanche diode Z2 provides a path for current during start-up.

Figure 9:
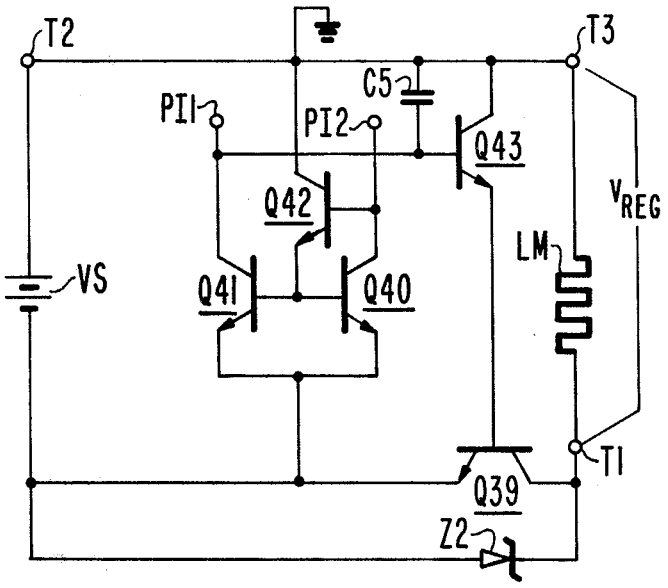
FIG. 9 is a schematic diagram of a portion of an alternative shunt voltage regulator connection for using a similar feedback network to that shown in FIGS. 1 or 2.

FIG. 9 shows another modification that can be made to the FIG. 1 or FIG. 2 regulator which results in a series voltage regulator for maintaining a negative voltage between terminals T1 and T3. The ground connection is relocated from terminal T1 to an interconnection between terminals T2 and T3. T1 is connected to the negative pole of voltage source VS by an NPN series regulator transistor Q39, connected at its collector to T1 and at its emitter to the negative pole of voltage source VS. The current mirror amplifier comprising Q13, Q14 and Q15 and having its input and output connections to points of interconnection PI1 and PI2, respectively, is replaced by a similar current mirror amplifier comprising NPN transistors Q40, Q41 and Q42 and having its input and output connections to points of interconnection PI2 and PI1, respectively. This current mirror amplifier converts the balanced variations in the collector currents of Q8 and Q9 to single-ended form for application to the base of an NPN emitter-follower transistor Q43, the collector of which connects to terminal T2 and the emitter of which connects to the base of Q39. C5 replaces C1 for determining the dominant time constant of the regulator, and Q16 and Q17 are disposed with. Avalanche diode Z2 provides a path for current during start-up.

One of the advantages voltage regulators of the sort described above have over the earlier Hilbiber and Graf regulators is the ease with which monolithic constructions can be altered to trim the temperature-coefficients of the voltage regulating elements to fit design requirements or to change the regulated voltage. Rather than having to make changes in diode structures that are replicated, the formation of each of which involves several masking steps, one need only to change the mask which controls the size of the resistors R2, R3, R4, R5, R6 and R7 in two or three places.

In still other embodiments of the present invention, one of the reference potential generating configurations — either that comprising Q3, Q4, R4, R5 or that comprising Q6, Q7, R6, R7 — may be replaced by a string of forward-biased semiconductor diodes, such as self-biased transistors, with the other reference potential generating configuration being used to develop an offset voltage equal to a transistor emitter-base offset potential multiplied by a non-integral factor.

The foregoing disclosure will permit one skilled in the art to develop numerous other embodiments of the present invention and this should be borne in mind when determining the scope of the following claims.

What is claimed is:

1. In a potential regulator having first and second terminals for connection to a load and having means responsive to a control signal for controlling the flow of current between said first and second terminals, improved voltage feedback network means having an input circuit connected for sensing the voltage between said first and second terminals and having an output circuit for developing an error signal indicative of the departure of the voltage between said first and second terminals from a prescribed value, which error signal is applied as said control signal to said means for controlling the flow of current between said first and second terminals, said improved voltage feedback network means comprises:

means for applying a fixed portion of the potential appearing between said first and second terminals between first and second nodes;

a first potential follower means having an input connection to said second node and having an output connection to a third node for maintaining said third node at a fixed potential with respect to the potential at said second node;

means for maintaining a fourth node at a fixed potential with respect to the potential at said first node, which fixed potential has the same value as the fixed potential said third node is maintained at with respect to said second node by said first potential follower;

means for generating between said third node and a fifth node a relatively small reference potential proportionally related by a factor m to the potential appearing across a semiconductor device operated with a relatively low density of current flow therethrough, m being a positive number;

means for generating between said fourth node and a sixth node a relatively large reference potential proportionally related by a factor (m+n) to the potential appearing across a further semiconductor device operated with a relatively high density of current flow therethrough, n being a positive number; and a differential-input amplifier having respective ones of its non-inverting and inverting input connections at said fifth node and at said sixth node and having an output terminal at which said error signal appears, said differential-input amplifier being of a type providing substantially zero-valued error signal when the potentials received at its inverting and non-inverting input connections are equal to each other.

2. The improved feedback network of claim 1 wherein m and n are respectively larger than and smaller than unity.

3. The improved feedback network of claim 1 or 2 wherein said means for maintaining a fourth node at a fixed potential with respect to the potential at said first node includes a second potential follower means having an input connection to said first node and having an output connection to said fourth node.

4. The improved feedback network of claim 1 or 2 wherein said first potential follower means maintains said third node at zero potential with respect to the potential at said second node, and wherein said means for maintaining a fourth node at a fixed potential with respect to the potential at said first node consists of a direct connection without substantial intervening impedance between said first and fourth nodes.

5. The improved feedback network set forth in claim 1 having:

first and second transistors of the same semiconductor material, with respective emitter and base and collector electrodes, and with respective base-emitter junctions of similar doping profile;

first current source means for applying a current between the emitter and base electrodes of said first transistor;

second current source means for applying a current between the emitter and base electrodes of said second transistor;

a first potential divider being included together with said first transistor in said means for generating a relatively small reference potential, having an input connection at said fifth node to which the collector electrode of said first transistor is direct coupled, having an output connection to the base electrode of said first transistor, and having a common connection to said third node; and a second potential divider being included together with said second transistor in said means for generating a relatively large reference potential, having an input connection at said sixth node to which the collector electrode of said second transistor is direct coupled, having an output connection to the base electrode of said second transistor, and having a common connection to said fourth node.

6. A voltage regulator of the type wherein the regulated voltage is with reference to a multiple of the difference between first and second voltages, the first voltage being the offset potential provided between first and second nodes by a first circuit connected therebetween, which first voltage equals (m+n) times the offset potential across a first forward-biased semiconductor junction operated at a relatively high current density, and the second voltage being the offset potential provided between third and fourth nodes by a second circuit connected therebetween, which second voltage equals m times the offset potential across a second forward-based semiconductor junction operated at a relatively low current density, m and n being positive numbers, improved in that said first circuit includes:

a transistor having an emitter electrode at said first node, having a base electrode, having an emitter-base junction corresponding to said first semiconductor junction, and having a collector electrode connected for permitting collector current flow and direct coupled to said second node; and divider means for dividing the potential appearing between said first and second nodes for application between said first node and the base electrode of said transistor, which divider means includes first and second resistive elements respectively connecting said first node and said second node to the base electrode of said transistor.

7. A voltage regulator as set forth in claim 6 wherein the resistances of said first and second resistive elements are in non-integral ratio to each other.

8. A voltage regulator as set forth in claim 7 wherein said second circuit includes:

a further transistor having an emitter electrode at said third node, having a base electrode, having an emitter-base junction corresponding to said second semiconductor junction, and having a collector electrode connected for permitting collector current flow and direct coupled to said fourth node; and further divider means for dividing the potential appearing between said third and fourth nodes for application between said third node and the base electrode of said further transistor, which divider means includes third and fourth resistive elements respectively connecting said third node and said fourth node to the base electrode of said further transistor, the resistances of said third and fourth elenents being in a ratio departing from said non-integral ratio by less than unity.

9. A voltage regulator of the type wherein the regulated voltage is with reference to a multiple of the difference between first and second voltages, the first voltage being the offset potential provided between first and second nodes by a first circuit connected therebetween which first voltage equals m+n times the offset potential across a first forward-based semiconductor junction operated at a relatively high current density, and the second voltage being the offset potential provided between third and fourth nodes by a second circuit connected therebetween, which second voltage equals m times the offset potential across a second forward-based semiconductor junction operated at a relatively low current density, m and n being positive numbers, improved in that said second circuit includes:

a transistor having an emitter electrode at said third node, having a base electrode, having an emitter-base junction corresponding to said second semiconductor junction, and having a collector electrode connected for permitting collector current flow and direct coupled to said fourth node; and divider means for dividing the potential appearing between said third and fourth nodes for application between said third node and the base electrode of said transistor, which divider means includes first and second resistive elements respectively connecting said third node and said fourth node to the base electrode of said transistor.

10. A voltage regulator as set forth in claim 9 wherein the resistances of said first and second resistive elements are in non-integral ratio to each other.

11. A voltage regulator as set forth in claim 10 wherein said second circuit includes:

a further transistor having an emitter electrode at said first node, having a base electrode, having an emitter-base junction corresponding to said first semiconductor junction, and having a collector electrode connected for permitting collector current flow and director coupled to said second node; and further divider means for dividing the potential appearing between said first and second nodes for application between said first node and the base electrode of said further transistor, which divider means includes third and fourth resistive elements respectively connecting said first node and said second node to the base electrode of said further transistor, the resistances of said third and fourth elements being in a ratio departing from said non-integral ratio by less than unity.

* * * * *